US008123544B2

(12) United States Patent
Kobayashi

(10) Patent No.: US 8,123,544 B2
(45) Date of Patent: Feb. 28, 2012

(54) ELECTRICAL CONNECTOR ASSEMBLY ADAPTED TO WITHSTAND ROTATIONAL MOVEMENT

(75) Inventor: Katsuhiko Kobayashi, Yamanashi (JP)

(73) Assignee: Tyco Electronics Japan G.K., Kawasaki-shi (JP)

( * ) Notice: Subject to any disclaimer, the term of this patent is extended or adjusted under 35 U.S.C. 154(b) by 0 days.

(21) Appl. No.: 12/916,991

(22) Filed: Nov. 1, 2010

(65) Prior Publication Data

US 2011/0045685 A1 Feb. 24, 2011

Related U.S. Application Data

(63) Continuation of application No. PCT/JP2009/058279, filed on Apr. 27, 2009.

(30) Foreign Application Priority Data

May 1, 2008 (JP) ..... 2008-119847

(51) Int. Cl.
*H01R 13/627* (2006.01)

(52) U.S. Cl. ..... 439/350; 439/352

(58) Field of Classification Search ..... 439/350, 439/352, 353, 357, 358
See application file for complete search history.

(56) References Cited

U.S. PATENT DOCUMENTS

| | | | | |
|---|---|---|---|---|
| 2,891,103 | A * | 6/1959 | Swengel | 439/350 |
| 4,284,313 | A * | 8/1981 | Anhalt | 439/350 |
| 4,398,073 | A * | 8/1983 | Botz et al. | 200/295 |
| 4,597,620 | A * | 7/1986 | Lindner et al. | 439/277 |
| 6,398,579 | B1 * | 6/2002 | Banas et al. | 439/372 |
| 6,848,931 | B2 * | 2/2005 | McMullen et al. | 439/350 |
| 7,081,002 | B2 * | 7/2006 | de Vanssay et al. | 439/350 |
| 7,513,788 | B2 * | 4/2009 | Camelio | 439/352 |
| 7,695,302 | B2 * | 4/2010 | Eissner et al. | 439/352 |
| 2004/0014350 | A1 * | 1/2004 | McMullen et al. | 439/350 |
| 2004/0214465 | A1 | 10/2004 | Takada | |

FOREIGN PATENT DOCUMENTS

| | | |
|---|---|---|
| JP | 10-223317 | 8/1998 |
| JP | 2002-252066 | 9/2002 |
| JP | 2003-338340 | 11/2003 |
| JP | 2004-039600 | 2/2004 |

OTHER PUBLICATIONS

International Search Report for co-pending PCT/JP2009/058279, dated May 29, 2009, 2 pages.

International Preliminary Report on Patentability and Written Opinion of ISA cited in co-pending International Application PCT/JP2009058279, dated Dec. 23, 2010, 5 pages.

* cited by examiner

*Primary Examiner* — Tho D Ta
(74) *Attorney, Agent, or Firm* — Barley Snyder

(57) ABSTRACT

An electrical connector assembly, which can easily disengage a first connector from a second connector without damaging constructional elements when excessive rotational moment is exerted on the one connector when connected to the second connector, is provided. The electrical connector assembly includes a first connector and a second connector that connect with each other. The first connector includes a first housing, a first contact, and a latch. The second connector includes a second housing having a second contact and a shell attached to the second housing so as to cover the second housing.

13 Claims, 7 Drawing Sheets

ELECTRICAL CONNECTOR ASSEMBLY ADAPTED TO WITHSTAND ROTATIONAL MOVEMENT

CROSS-REFERENCE TO RELATED APPLICATIONS

This application is a continuation of PCT International Application No. PCT/JP2009/058279, filed Apr. 27, 2009, which claims priority under 35 U.S.C. §119 to Japanese Patent Application No. JP 2008-119847, filed May 1, 2008.

FIELD OF THE INVENTION

The present invention relates to an electrical connector assembly, and in particular an electrical connector assembly having a first connector and a second connector which can easily disengage from one another by exerting an excessive rotational moment on the first connector.

BACKGROUND

A known electrical connector assembly 100 is shown in FIG. 7 and disclosed in JP 2004-39600 A. The electrical connector assembly 100 includes a plug 110 and a plug receptacle 130 that connect with each other. The plug 110 connects to a power cord 120, and the plug receptacle 130 mounts to a vessel body 140 of an electric pot or the like.

In this case, the plug 110 includes an insulating plug body 111, and a pair of plate springs 114 that are installed inside of the plug body 111.

A pair of plate spring receiving cavities 112 open in the front (bottom in FIG. 7) is provided in the plug body 111. In addition, a pair of magnet holders 113 is provided on left and right outer sides of the plate spring receiving cavities 112 in the plug body 111. A magnet 116 and a magnet 117 are integrally joined to the outer surface of the magnetic 116 and positioned in each of the magnet holders 113.

Moreover, the plate springs 114 are each formed of a metal that is resiliently deformable in the front-and-back direction. A core wire 121 of the power cord 120 is connected to each back end of the respective plate springs 114, and a contact portion 115 is provided on each front end of the respective plate springs 114.

Furthermore, the plug receptacle 130 with which the plug is mated includes an insulating plug receptacle body 131 attached to the vessel body 140 and a pair of electrode pins 133 mounted on the plug receptacle body 131.

The plug receptacle body 131 includes a plug-receiving recess 132 open in the front. A pair of magnetic material 134 (not magnetized) is provided on left and right outer sides of the plug-receiving recess 132 in the plug receptacle body 131 so as to face the plug-receiving recess 132. The magnetic materials 117 provided on the plug 110 are to abut the magnetic material 134, respectively.

The respective electrode pins 133 are pin members made of metal, and are provided at positions where the contact portions 115 of the respective plate springs 114 provided on the plug 110 make contact.

When the plug 110 is inserted in the plug receptacle 130 in the direction of arrow A in FIG. 7, the respective electrode pins 133 are inserted into the respective plate spring receiving cavities 112 of the plug 110. Then, tip ends of the respective electrode pins 133 make contact with the contact portions 115 of the respective plate springs 114, and the respective electrode pins 133 depress the respective plate springs 144 (each of the plate springs is elastically deformed rearward), generating a predetermined contact pressure. Moreover, at this time, the magnetic materials 117 of the plug 110 are attracted to the magnetic material 134 of the plug receptacles 130, respectively, when the front face of the plug 110 abuts the bottom of the plug-receiving recess 132 of the plug receptacle 130.

Accordingly, excessive rotational moment may be exerted on the plug 110 in the left-and-right direction (direction of arrow B in FIG. 7) or up-and-down direction (direction orthogonal to the space in FIG. 7), and an external force at least equal to attractive force between the magnetic materials 117 and the magnetic material 134 may be exerted on the plug 110. For example, this is a case when an article is caught by the power cord 120 connected to the plug 110. In this case, the plug 110 becomes disengaged from the plug receptacle 130, cutting off power distribution. In this manner, mechanical connection of the plug 110 and the plug receptacle 130 in the electrical connector assembly 100 is made using magnetic materials. As a result, the plug 110 may be easily disengaged from the mating plug receptacle 130 by exerting excessive rotational moment on the plug 110.

In addition, an known electrical connector assembly having a known connector 200 can be easily disengaged from the mated counterpart connector is disclosed in JP 2002-252066 A, and shown in FIG. 8 and FIG. 9.

The electrical connector 200 is a known right-angled coaxial electrical connector, as shown in FIG. 8, and connects a coaxial cable (not illustrated in the drawings) to a mating coaxial connector (not illustrated in the drawings). The electrical connector 200 includes a shell subassembly 210, a collar subassembly 220, a pin contact 230, and a dielectric 240.

The shell subassembly 210 includes a metal back shell 211 connected to the outer conductor of the coaxial cable. A through-hole 212 extending in the front-and-back direction to receive the dielectric 240 is formed in the back shell 211. A metal front shell 213 is attached to the front end of the back shell 211. The front shell 213 is a cylindrical member having multiple flexible cantilever spring fingers 216 extending frontward from a cylindrical base 214, as shown in FIG. 9. Between adjacent spring fingers 216 are slits 215 that open on the front side, allowing the respective spring fingers 216 to easily deflect inward and outward. Ribs 217 protruding inward are positioned near the front ends of the respective spring fingers 216. Each of the ribs 217 are made to engage with an opposite surface of the outer conductor of the mating coaxial connector.

The collar subassembly 220 includes a housing 221 arranged at a position where a part of the front shell 213 and the back shell 211 surrounds. The housing 221 is movable between a neutral position shown in FIG. 8 and back-and-forth positions before and after the neutral position. The housing 221 is made to control displacement of outer sides of the respective spring fingers 216 when in the neutral position. Coil springs 222, which urge the back shell 211 and the housing 221 in respective opposite directions from each other to the front-and-back direction, are provided on the periphery of the back shell 211.

The dielectric 240 is placed within the through-hole 212 of the back shell 211. The pin contact 230 is a metal pin member functioning as a central conductor, and is arranged at the center portion of the dielectric 240. The front end side of the pin contact 230 protrudes inward of the front shell 213.

In order to connect the mating coaxial connector with the electrical connector 200 that is configured as such, a hand is used to make the housing 221 of the collar subassembly 220 resist compressive force of the coil springs 222 so as to move rearward. Then, displacement of the outer sides of the respective spring fingers 216 provided in the front shell 213 is possible. When the mating coaxial connector connects within the front shell 213, the respective spring fingers 216 in the front shell 213 are displaced outward, and the pin contact 230 makes contact with a central contact (not illustrated in the drawings) of the mating coaxial connector. When the hand releases the housing 221 of the collar subassembly 220, the housing 221 is positioned at the natural position, and outward movement of the respective spring fingers 216 is controlled, completing mating thereof.

In order to release the mating of the mating coaxial connector with the electrical connector 200, a hand is used to make the housing 221 of the collar subassembly 220 resist compressive force of the coil springs 222 so as to move rearward. Then, displacement of the outer sides of the respective spring fingers 216 provided in the front shell 213 is possible. In this state, when the mating coaxial connector is pulled out of the front shell 213, the respective spring fingers 216 in the front shell 213 are displaced outward, canceling the contact condition of the central contact of the mating coaxial connector with the pin contact. This releases the mating of the mating coaxial connector with the electrical connector 200.

With such electrical connector 200, easy outward displacement of the respective spring fingers 216 in the front shell 213 is possible when pulling out the mating coaxial connector from the front shell 213. As a result, the mating coaxial connector may be easily removed from the electrical connector 200.

However, the electrical connector assembly 100 shown in FIG. 7 and the electrical connector 200 shown in FIG. 8 have several problems.

Namely, in the case of the electrical connector assembly 100 shown in FIG. 7, the plate springs 114 are elastically deformable in the front-and-back direction in order to bias the contact portions 115. Therefore, relatively large spaces in the front-and-back direction for holding the plate springs 114 are required.

Moreover, since mechanical connection of the plug 110 and the plug receptacle 130 is made using magnetic materials, there are such problems that external magnetic metal is attracted to the magnetic materials, which increases the costs of manufacturing and repair. Particularly, when the electrical connector assembly 100, connected to a DC power cable of a laptop computer or the like, is used, there is chance that the magnetic materials may adversely affect card magnetic data.

Furthermore, in the case of the electrical connector 200 shown in FIG. 8, there is an inconvenience when excessive rotational moment has been exerted on the mating coaxial connector in the left-and-right direction or the up-and-down direction in a connected state of the electrical connector 200 and mating coaxial connector. Namely, since mating length of the electrical connector 200 and mating coaxial connector is long, when the aforementioned rotational moment is exerted on the mating coaxial connector, constructional elements of the electrical connector 200 including the pin contact 230 and constructional elements of the mating coaxial connector may be damaged.

SUMMARY

Accordingly, the invention has been made to solve the above problems, among others, and it is an objective of the invention to provide an electrical connector assembly, which can easily disengage a connector from a mating connector without damaging the constructional elements, notably when excessive rotational moment is exerted on the connector in a connected state.

The electrical connector assembly includes a first connector and a second connector that connect with each other. The first connector includes a first housing, a first contact, and a latch. The second connector includes a second housing having a second contact and a shell attached to the second housing so as to cover the second housing.

BRIEF DESCRIPTION OF THE DRAWINGS

The invention is described in more detail in the following with reference to the embodiments shown in the drawings. Similar or corresponding details in the Figures are provided with the same reference numerals. The invention will be described in detail with reference to the following figures of which.

DETAILED DESCRIPTION OF THE EMBODIMENT(S)

Hereafter, an embodiment of the invention will be described with reference to the drawings.

Figure 1:
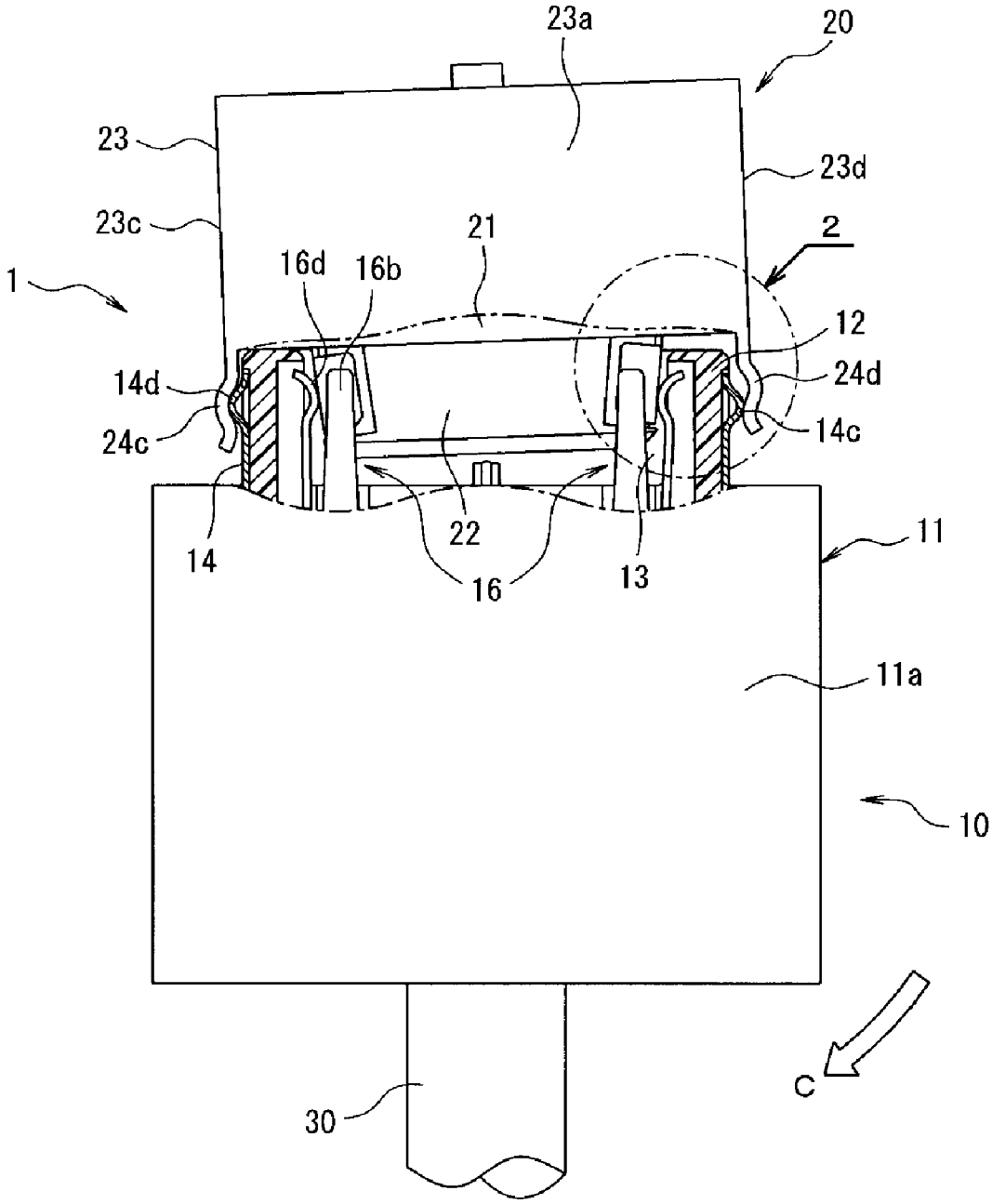
FIG. 1 is a plan view of an electrical connector assembly according to the invention, and shows as a partial cross-sectional view of a rear surface side.

An electrical connector assembly 1 according to the invention is shown in FIG. 1. The electrical connector assembly includes a first connector 10 and a second connector 20 that connect with each other. A power cable 30, for example, a direct-current power cable of a laptop personal computer is connected to the first connector 10. Meanwhile, the second connector 20 is mounted on a circuit board (not illustrated in the drawing), for example, a circuit board within the laptop personal computer.

Figure 5A:
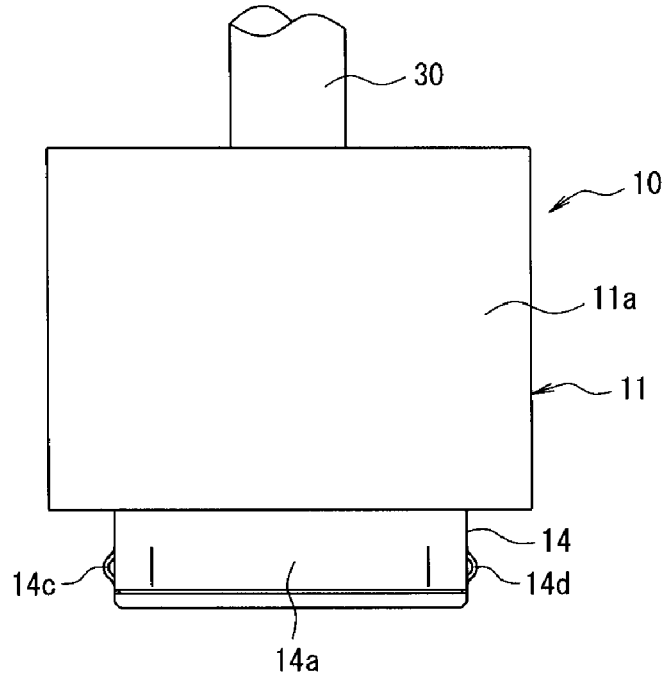
FIG. 5A is a plan view of the first connector of the electrical connector assembly of FIG. 1.
Figure 5B:
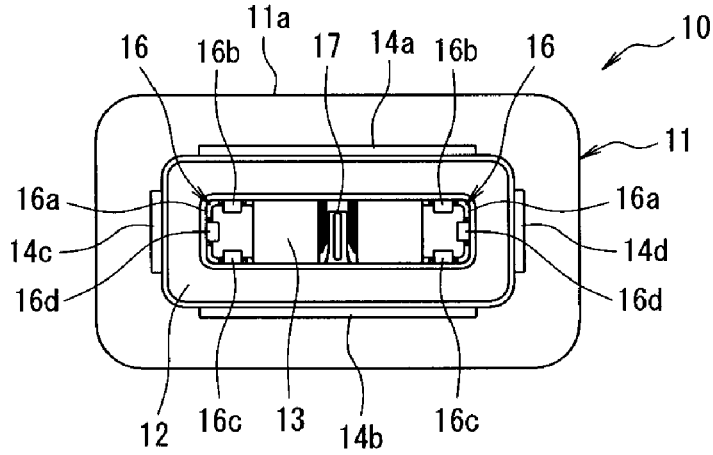
FIG. 5B is a front view of the first connector of the electrical connector assembly of FIG. 1.
Figure 5C:
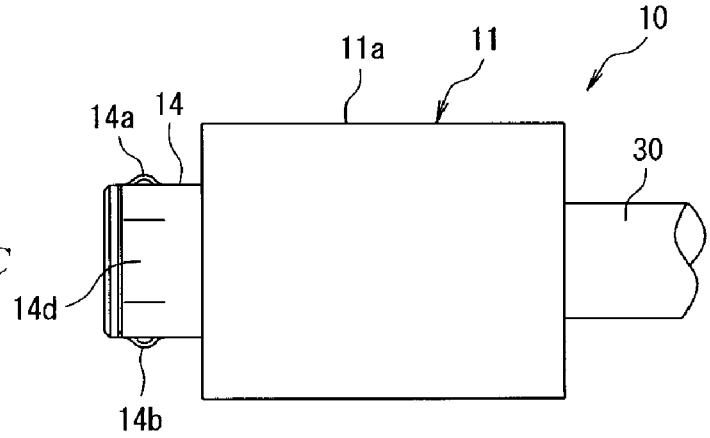
FIG. 5C is a side view of the first connector of the electrical connector assembly of FIG. 1.

The first connector 10 has a first housing 11, two first contacts 16, and a latch 14, as shown in FIG. 1 and FIG. 5.

The first housing 11 includes a housing main body 11*a* having an approximate rectangular solid shape, and a first mating part 12, which protrudes forward from the front end of the housing main body 11*a*, as shown in FIG. 1, FIG. 4, and FIG. 5. The first housing 11 is formed by molding an insulating synthetic resin. The first mating part 12 has an approximate rectangular shape with smaller dimensions than the housing main body 11*a*. An approximately rectangular mating recess 13 having an aperture open to a front face is formed in the first mating part 12. The front end side of the first mating part 12 is a mating side for connection with the second connector 20.

The two first contacts 16 are contained within left and right ends of the mating recess 13 as shown in FIG. 5B. The first contacts 16 on the left and right sides are formed in mirror symmetry. Each of the first contacts 16 has a base 16*a*, an upper elastic contact portion 16*b*, a lower elastic contact portion 16*c*, and a side elastic contact portion 16*d*, as shown in FIG. 1 to FIG. 4 and FIG. 5B. The respective first contacts 16 are formed by stamping and forming sheet metal. The base 16*a* is attached to the housing main body 11*a* of the first housing 11, and the back end side thereof is connected to the core wire (not illustrated in the drawings) of the power cable 30. The upper elastic contact portion 16*b* extends in a cantilever form from the base 16*a* toward the upper side of a second mating part 22 and the mating side, as shown in FIG. 4B. This upper elastic contact portion 16*b* makes elastic contact from above with an upper contact portion 26*a* of a second contact 26 described later provided on the second connector 20. The lower elastic contact portion 16*c* extends in a cantilever form from the base 16*a* toward the lower side of the second mating part 22 and the mating side. This lower elastic contact portion 16*c* makes elastic contact from below with a lower contact portion 26*b* of the second contact 26 on the second connector 20. Furthermore, the side elastic contact portion 16*d* extends in a cantilever form from the base 16*a* toward the side of the second mating part 22 and the mating side. The side elastic contact portion 16*d* of the left side first contact 16 extends toward the right side of the second mating part 22. Moreover, the side elastic contact portion 16*d* of the right side first contact 16 extends toward the left side of the second mating part 22. These side elastic contact portions 16*d* make elastic contact from the sides with side contact portions 26*c* of the second contact 26, respectively.

The latch 14 is attached to the first housing 11 so as to cover the first mating part 12, as shown in FIG. 1, FIG. 4, and FIG. 5. The latch 14 is formed by stamping and forming sheet metal. The latch 14 includes an upper latching part 14*a*, which extends to the mating side along the top of the first mating part 12, and a lower latching part 14*b*, which extends to the mating side along the bottom of the first mating part 12 and is paired with the upper latching part 14*a*. The latch 14 also includes a left latching part 14*c*, which extends to the mating side along the left side of the first mating part 12, and a right latching part 14*d*, which extends to the mating side along the left side of the first mating part 12 and is paired with the left latching part 14*c*. As a result, the latch 14 includes two pairs of latching parts: the upper latching part 14*a* and the lower latching part 14*b*, and the left latching part 14*c* and the right latching part 14*d*. A projection convexly curving outward is formed on the respective latching parts 14*a*, 14*b*, 14*c*, and 14*d*, and these projections latch onto and engage with recesses concavely curving inside of elastic latching parts 24*a*, 24*b*, 24*c*, and 24*d*, respectively, described later.

Figure 6A:
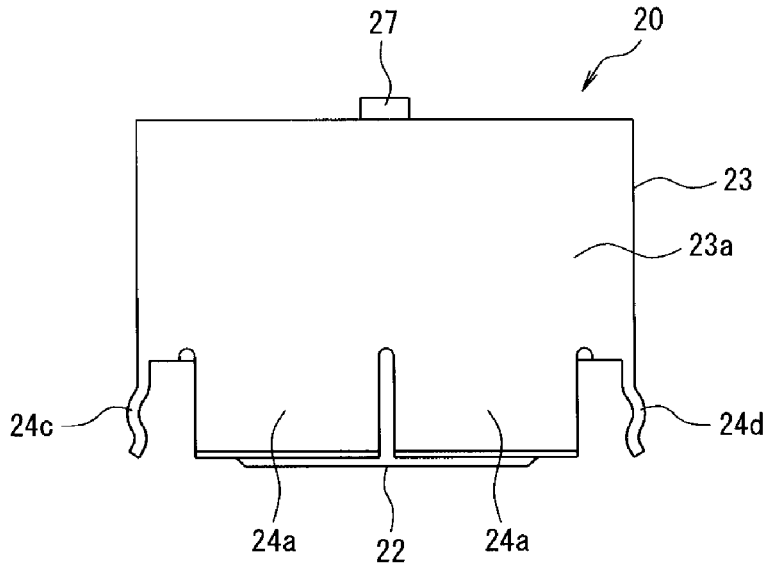
FIG. 6A is a plan view of the second connector of the electrical connector assembly of FIG. 1.

Meanwhile, the second connector 20 has a second housing 21, two second contacts 26, and a shell 23, as shown in FIG. 1 and FIG. 6.

The second housing 21 is formed in an approximately rectangular solid form and includes the second mating part 22 protruding forward from the front end surface thereof. The second housing 21 and the second mating part 22 are formed integrally by molding an insulating synthetic resin. The second mating part 22 is formed in an approximate rectangular solid form with smaller dimensions than the second housing 21 and allowing reception within the mating recess 13 of the first housing 11. The front end side of the second mating part 22 is the mating side with the first connector 10.

Figure 6B:
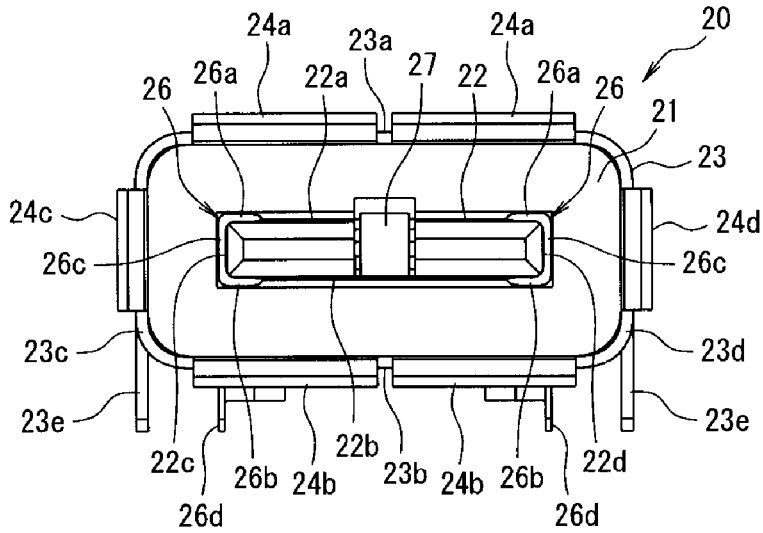
FIG. 6B is a front view of the second connector of the electrical connector assembly of FIG. 1.

The two second contacts 26 are placed on left and right ends of the second mating part 22 as shown in FIG. 6B. The second contacts 26 on the left and right sides are formed in mirror symmetry. Each of the second contacts 26 have the upper contact portion 26*a*, the lower elastic contact portion 26*b*, the side contact portion 26*c*, and a leg 26*d*, as shown in FIG. 1 to FIG. 4 and FIG. 6B. The respective second contacts 26 are formed by stamping and forming sheet metal. One end of the leg 26*d* is attached to the second housing 21, and the other end thereof is bent in an approximate right angle connected to the circuit board (not illustrated in the drawings) on which the second connector 20 is mounted. The upper contact portion 26*a* extends to the mating side along a top surface 22*a* of the second mating part 22 from one end side of the leg 26*d*. This upper contact portion 26*a* makes contact with the bottom surface of the upper elastic contact portion 16*b* of the first contact 16. Moreover, the lower contact portion 26*b* extends to the mating side along bottom surface 22*b* of the second mating part 22 from the other end side of the leg 26*d*. This lower contact portion 26*b* makes contact with the top surface of the lower elastic contact portion 16*c* of the first contact 16. Furthermore, the side contact portion 26*c* extends to the mating side along a side surface 22*c* of the second mating part 22 from the one end side of the leg 26*d*. The side contact portion 26*c* on the right side second contact 26 extends along the left side surface of the second mating part 22, and the side contact portion 26*c* on the left side second contact 26 extends along the right side surface of the second mating part 22. These side contact portions 26*c* make contact with the side surfaces of the side elastic contact portion 16*d* of the first contact 16, respectively.

The shell 23 is attached to the second housing 21 so as to cover it, as shown in FIG. 1 to FIG. 4 and FIG. 6. The shell 23 is formed by stamping and forming a metal member. The shell 23 includes two upper elastic latching parts 24*a*, which are positioned on the upper outer side of the second mating part 22 and extend in a cantilever form to the mating side from an upper wall surface 23*a* of the shell 23. The shell 23 also includes two lower elastic latching parts 24*b*, which are positioned on the lower outer side of the second mating part 22 and extend in a cantilever form to the mating side from a lower wall surface 23*b* of the shell 23, and are paired with the two upper elastic latching parts 24*a*. The shell 23 further includes a left elastic latching part 24*c*, which is positioned on the left outer side of the second mating part 22 and extends in a cantilever form to the mating side from a left wall surface 23*c* of the shell 23. Moreover, the shell 23 includes a right elastic latching part 24*d*, which is positioned on the right outer side of the second mating part 22 and extends towards the mating side from a right wall surface 23*d* of the shell 23, and is paired with the left elastic latching part 24*c*. As a result, the shell 23 includes three pairs of latching parts: the upper latching parts 24*a* and the lower latching parts 24*b* making two pairs, and the left latching part 24*c* and the right latching part 24*d* making a pair. A recess that curves inward is formed on the respective elastic latching parts 24*a*, 24*b*, 24*c*, and 24*d*, and the projections of the latching parts 14*a*, 14*b*, 14*c*, and 14*d* elastically latch onto and engage with these recesses, respectively. Furthermore, fixing parts 23*e* fixing the shell 23 to the circuit board are provided on the left and right wall surfaces 23*c* and 23*d* of the shell 23.

Figure 6C:
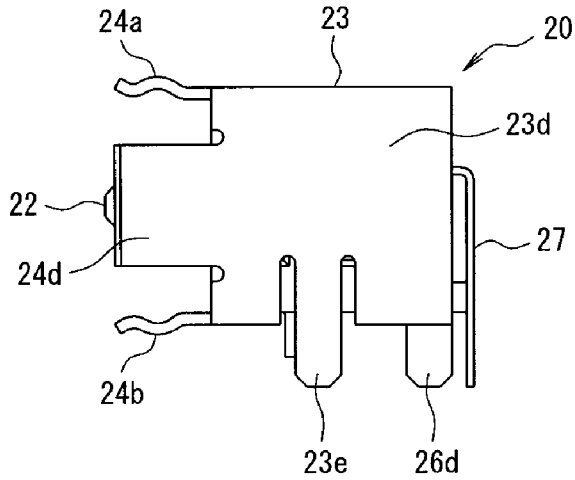
FIG. 6C is a side view of the second connector of the electrical connector assembly of FIG. 1.

Note that reference numeral 27 in FIG. 6B denotes a mating detection contact provided at the center in the left-and-right direction of the second mating part 22. This mating detection contact 27 makes contact with a mating detection terminal 17 (see FIG. 5B) provided on the first connector 10 when the first connector 10 and the second connector 20 are mated. The mating detection contact 27 is bent in an approximate right angle once it extends outward from the second connector 20 and connected to the circuit board, as shown in FIG. 6C.

Next, a method of mating the first connector 10 and the second connector 20 is described.

The second mating part 22 of the second connector 20 connects with the mating recess 13 of the first mating part 12 in the first connector 10. Accordingly, the upper latching part 14*a* of the first connector 10 latches onto the upper elastic latching part 24*a* of the second connector 20, the lower latching part 14*b* latches onto the lower elastic latching part 24*b*, the left latching part 14*c* latches onto the right elastic latching part 24*d*, and the right latching part 14*d* latches onto the left elastic latching part 24*c*. This completes mating of the first connector 10 and the second connector 20.

At the time of connection between the first connector 10 and the second connector 20, the first contact 16 of the first connector 10 makes elastic contact with the second contact 26 of the second connector 20. At this time, the upper elastic contact portion 16*b* of the first contact 16 makes elastic contact from above with the upper contact portion 26*a* of the second contact 26. Moreover, the lower elastic contact portion 16*c* makes elastic contact from below with the lower contact portion 26*b* of the second contact 26. Furthermore, the side elastic contact portions 16*d* make elastic contact from the sides with the side contact portions 26*c* of the second contact 26, respectively. In this manner, the first contact 16 and the second contact 26 make contact at three points, allowing improvement in contact certainty. Since the first contact 16 is connected to the power cable 30, relatively large current flows to the first contact 16 and the second contact 26, and contact is made at three points, this surely allows a large current to flow.

In order to release the mating of the first connector 10 and the second connector 20, the first contact 10 connected to the power cable 30 should be pulled out of the second connector 20. This releases the latching engagement of the elastic latching parts 24*a*, 24*b*, 24*c*, and 24*d* and the latching parts 14*a*, 14*b*, 14*c*, and 14*d*, respectively, and the mating of the first connector 10 and the second connector 20.

Here, excessive rotational moment may be exerted on the first connector 10 in the left-and-right direction and up-and-down direction when viewed from the rear surface side. For example, when an article may catch the power cord 30 connected to the first connector 10.

Figure 2:
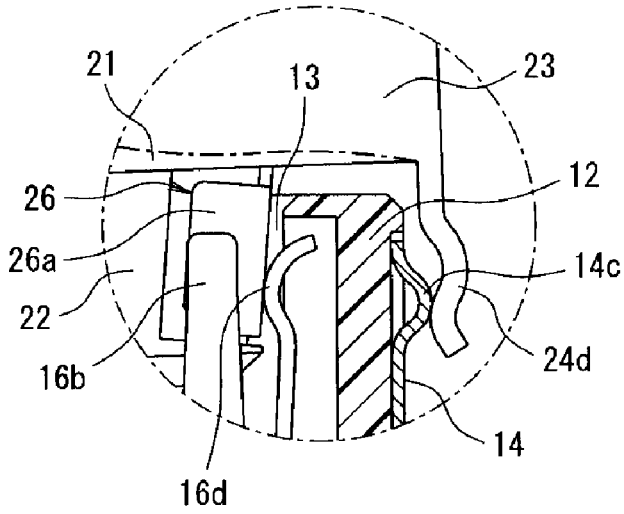
FIG. 2 is an enlarged view of a portion of the electrical connector assembly indicated by arrow 2 in FIG. 1, showing a first and second connector of the electrical connector assembly according to the invention.
Figure 3:
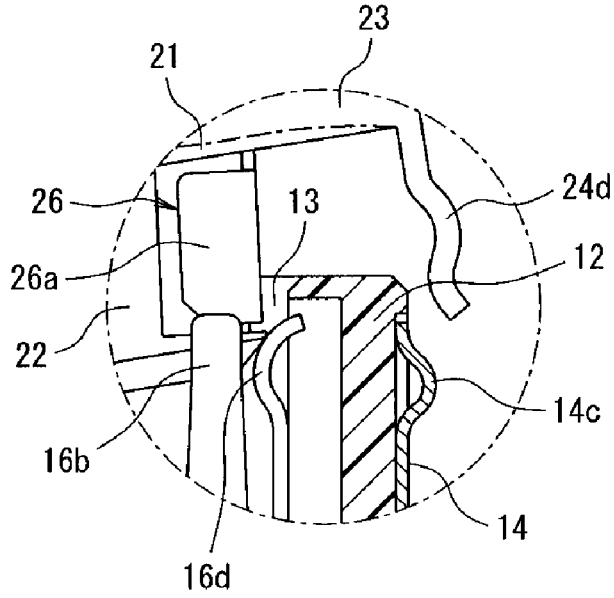
FIG. 3 is an enlarged view of the portion indicated by arrow 2 in FIG. 1, showing a first connector of the electrical connector assembly rotated away from a second connector of the electrical connector assembly.
Figure 4A:
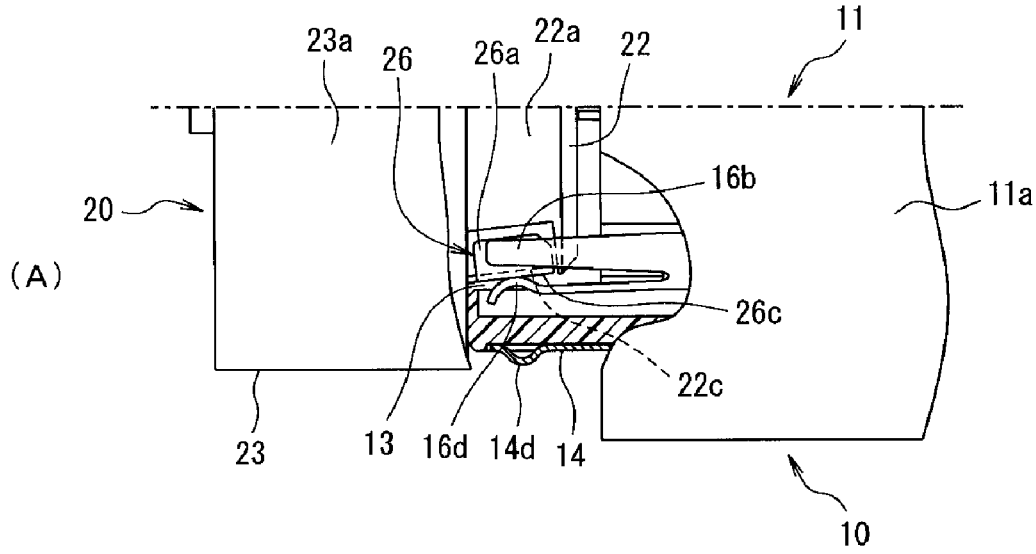
FIG. 4A is a partial cross-sectional view of the electrical connector assembly of FIG. 1 cut at a mating portion between the first and second connector.
Figure 4B:
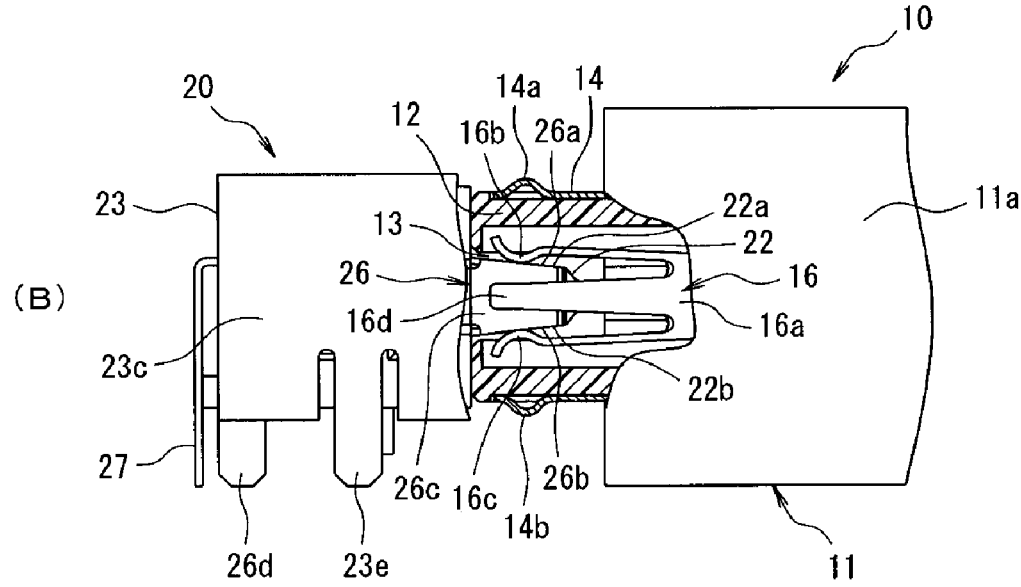
FIG. 4B is another partial cross-sectional view of the electrical connector assembly of FIG. 1 cut at the mating portion between the first and second connector.

FIG. 1 to FIG. 3 show operations of the left latching part 14*c* and the right elastic latching part 24*d*, and the right latching part 14*d* and the left elastic latching part 24*c* when excessive rotational moment has been exerted leftward (direction of arrow C) on the first connector 10 when viewed from the rear surface side in the mating state of the connectors 10 and 20.

As shown in FIG. 1, when excessive rotational moment is exerted leftward on the first connector 10, when viewed from the rear surface side, the first connector 10 rotates leftward with the left elastic latching part 24*c* of the second connector 20 and the right latching part 14*d* of the first connector 10 as a pivot point. Then, as shown in FIG. 1 to FIG. 3, latching engagements other than those based on said pivot point, namely latching engagement of the right elastic latching part 24*d* and the left latching part 14*c*, and although not illustrated in the drawings, latching engagement of the upper elastic latching part 24*a* and the upper latching part 14*a*, and latching engagement of the lower elastic latching part 24*b* and the lower latching part 14*b* are all released.

Moreover, although not illustrated in the drawings, when excessive rotational moment is exerted rightward on the first connector 10 when viewed from the rear surface side, the first connector 10 rotates rightward with the right elastic latching part 24*d* of the second connector 20 and the left latching part 14*c* of the first connector 10 as a pivot point. Then, latching engagements other than those based on said pivot point, namely latching engagement of the left elastic latching part 24*c* and the right latching part 14*d*, latching engagement of the upper elastic latching part 24*a* and the upper latching part 14*a*, and latching engagement of the lower elastic latching part 24*b* and the lower latching part 14*b* are all released.

Similarly, when excessive rotational moment is exerted upward on the first connector 10 when viewed from the rear surface side, the first connector 10 rotates upward with the upper elastic latching part 24*a* of the second connector 20 and the upper latching part 14*a* of the first connector 10 as a pivot point. Then, latching engagements other than those based on said pivot point, namely latching engagement of the lower elastic latching part 24*b* and the lower latching part 14*b*, latching engagement of the left elastic latching part 24*c* and the right latching part 14*d*, and latching engagement of the right elastic latching part 24*d* and the left latching part 14*c* are all released.

Similarly, when excessive rotational moment is exerted downward on the first connector 10 when viewed from the rear surface side, the first connector 10 rotates downward with the lower elastic latching part 24*b* of the second connector 20 and the lower latching part 14*b* of the first connector 10 as a pivot point. Then, latching engagements other than those based on said pivot point, namely latching engagement of the upper elastic latching part 24*a* and the upper latching part 14*a*, latching engagement of the left elastic latching part 24*c* and the right latching part 14*d*, and latching engagement of the right elastic latching part 24*d* and the left latching part 14*c* are all released.

In this manner, the first connector 10 according to the invention rotates in the up-and-down direction or left-and-right direction with a single elastic latching part of the second connector 20 and a single latching part of the first connector 10 as a pivot point and thereby releasing latching engagements other than those based on said pivot point, when excessive rotational moment is exerted on the first connector 10 in the up-and-down direction or left-and-right direction. Therefore, when excessive rotational moment has been exerted on the first connector 10 in a mating state, the latching engagement of the first connector 10 and the second connector 20 is easily released. Accordingly, the first connector 10 may be easily disengaged from the mating connector without damage to constructional elements.

Figure 7:
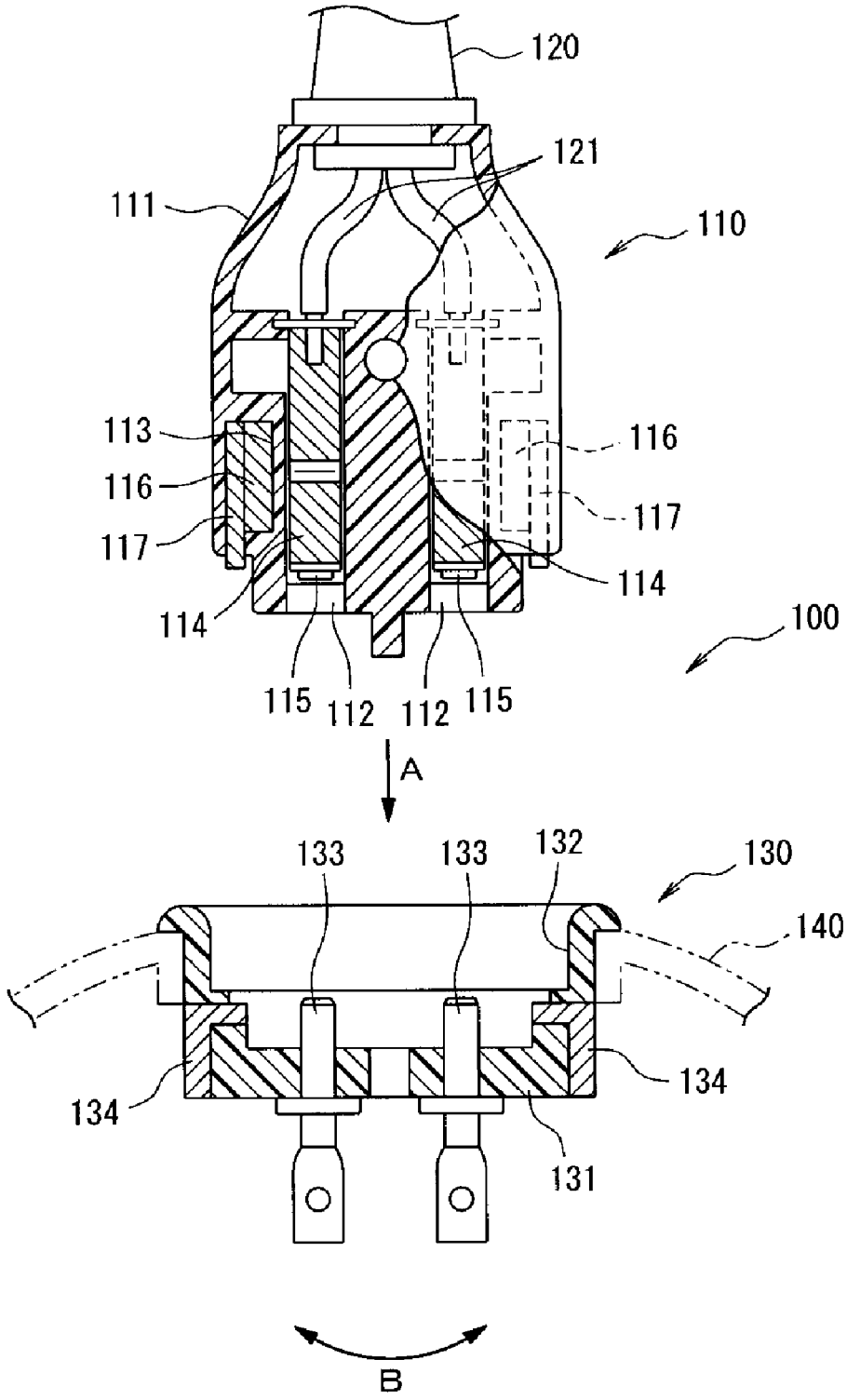
FIG. 7 is a cross-sectional view of a known electrical connector assembly.
Figure 8:
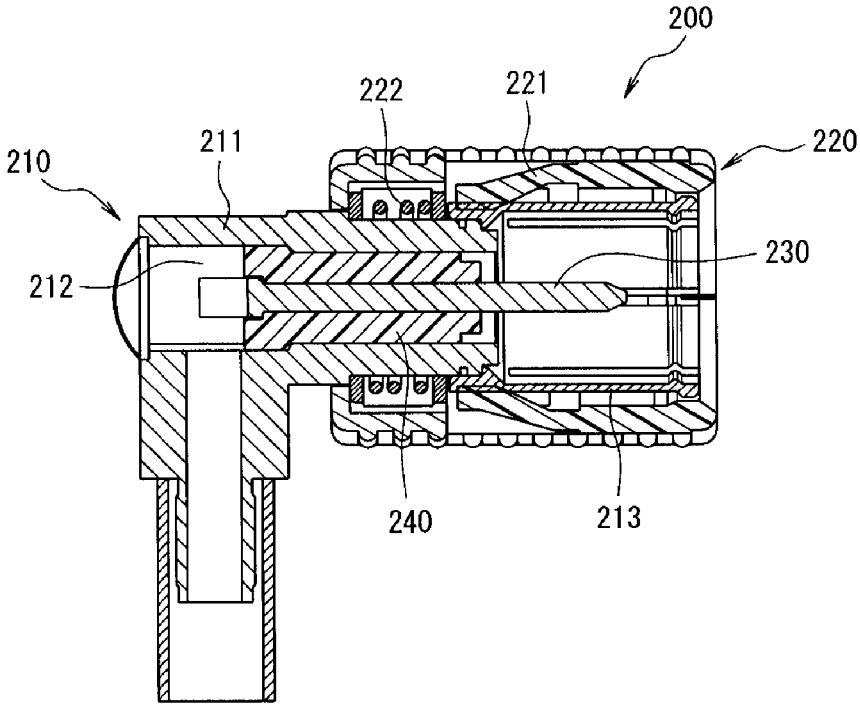
FIG. 8 is a cross-sectional view of a known electrical connector of another known electrical connector assembly.
Figure 9:
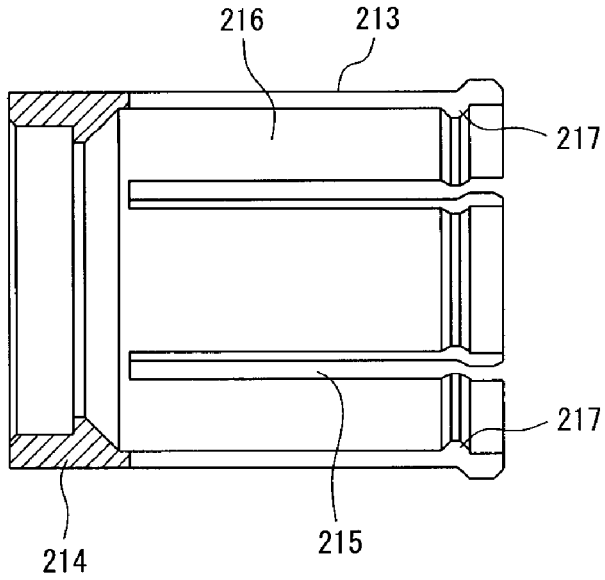
FIG. 9 is a cross-sectional view of an outer conductor used in the known electrical connector of FIG. 8.

With the electrical connector assembly 1 according to the invention, the plate springs 114 deformable in the front-and-back direction are not required to bias the contact portions 115, as with the conventional electrical connector assembly 100 shown in FIG. 7. Therefore, a small-sized electrical connector assembly may be provided without needing relatively large spaces in the front-and-back direction for holding the plate springs 114.

Moreover, with the electrical connector assembly 1 according to the invention, mechanical connection of the first connector 10 and the second connector 20 is prepared by latching engagements of the elastic latching parts 24*a*, 24*b*, 24*c*, and 24*d* and the latching parts 14*a*, 14*b*, 14*c*, and 14*d*, respectively. Therefore, unlike the electrical connector assembly 100 shown in FIG. 7, mechanical connection of the plug 110 and the plug receptacle 130 does not need to be made using magnetic materials. Accordingly, there is no issues of damage or increased cost from the magnetic materials.

The second mating part 22 of the second connector 20 is at a slant such that the top surface 22*a*, the bottom surface 22*b*, the left side surface 22*c*, and the right side surface 22*d* (only left side surface 22*c* is illustrated in FIG. 4A taper off so as to allow rotation of the first connector 10 in the up-and-down direction or left-and-right direction. Therefore, the second mating part 22 of the second connector 20 can certainly secure a gap before the joining recess 13, allowing the first connector 10 to rotate in the up-and-down direction or left-and-right direction. As a result, the electrical connector assembly 1 may be provided without the second mating part 22 of the second connector 20 hindering rotation of the first connector 10.

Furthermore, with the electrical connector assembly 1 according to the invention, the latching parts 14*a*, 14*b*, 14*c*, and 14*d* and the shell 23 having the elastic latching parts 24*a*, 24*b*, 24*c*, and 24*d* are made of metal. As a result, wear resistance of the latching parts 14*a*, 14*b*, 14*c*, and 14*d* of the first connector 10 and the elastic latching parts 24*a*, 24*b*, 24*c*, and 24*d* of the second connector 20 may be improved greater than in the case of non-metal members, such as resin, for example. Furthermore, by grounding the shell 23, the second connector 20 and the first connector 10 may be grounded via the latching parts 14*a*, 14*b*, 14*c*, and 14*d* and the elastic latching parts 24*a*, 24*b*, 24*c*, and 24*d*.

While embodiments of the invention have been illustrated, the present invention is not limited thereto, and various modifications and improvements are possible.

For example, two pairs of the latching parts 14*a*, 14*b*, 14*c*, and 14*d* of the first connector 10 are provided in the shown embodiment; however, not limited to two pairs, there should at least be two pairs of latching parts extending to the mating side along the upper and lower surfaces and left and right side surfaces of the first mating part 12.

Moreover, three pairs of the elastic latching parts 24*a*, 24*b*, 24*c*, and 24*d* of the second connector 20 are provided in the embodiment shown; however, not limited to three pairs, there should at least be two pairs of elastic latching parts extending to the joining side along the upper and lower wall surfaces and left and right wall surfaces of the shell 23 and positioned on the upper and lower outer sides and left and right outer sides of the second mating part 22.

Furthermore, a recess curving inward is formed on the respective elastic latching parts 24*a*, 24*b*, 24*c*, and 24*d*, and the projections of the latching parts 14*a*, 14*b*, 14*c*, and 14*d* elastically latch onto and engage with these recesses, respectively. However, shape of the respective elastic latching parts 24*a*, 24*b*, 24*c*, and 24*d*, and the latching parts 14*a*, 14*b*, 14*c*, and 14*d* is not limited thereto. When excessive rotational moment is exerted on the first connector 10 in the up-and-down direction or left-and-right direction, the first connector 10 should be configured so as to rotate in the up-and-down direction or left-and-right direction with a single elastic latching part of the second connector 20 and a single latching part of the first connector 10 as a pivot point, and release other latching engagements than those based on the pivot point.

What is claimed is:

1. An electrical connector assembly, comprising a first connector having a first housing, a first contact, and a latch;

a second connector that connects with the first connector and includes a second housing having a second contact, a shell attached to the second housing so as to cover the second housing, and a second mating part that receives the second contact;

wherein the second mating part is at a slant such that top and bottom surfaces and left and right side surfaces taper off so as to allow rotation of the first connector in the up-and-down direction or left-and-right direction.

2. The electrical connector assembly according to claim 1, wherein the first contact includes a base attached to the first housing.

3. The electrical connector assembly according to claim 1, wherein the first housing includes a first mating part having a mating recess receiving the first contact.

4. The electrical connector assembly according to claim 3, wherein the latch includes at least two pairs of latching parts attached to the first housing and extending to a mating side along upper and lower surfaces and left and right side surfaces of the first mating part.

5. The electrical connector assembly according to claim 4, wherein the shell includes at least two pairs of elastic latching parts that elastically latches onto and engage with the at least two pairs of latching parts of the first connector.

6. The electrical connector assembly according to claim 1, wherein the shell includes at least two pairs of elastic latching parts.

7. The electrical connector assembly according to claim 6, wherein the at least two pairs of elastic latching parts are positioned on upper and lower outer sides and left and right outer sides of the second mating part in the second housing, respectively.

8. The electrical connector assembly according to claim 7, wherein the at least two pairs of elastic latching parts extend to a mating side from upper and lower wall surfaces and left and right wall surfaces of the shell, respectively.

9. An electrical connector assembly, comprising a first connector having a first housing, a first contact having a base attached to the first housing, and a latch;

a second connector that connects with the first connector and includes a second housing having a second contact and a shell attached to the second housing so as to cover the second housing;

wherein the first contact includes an upper elastic contact portion which extends to a mating side and an upper side of a second mating part of the second housing from the base.

10. The electrical connector assembly according to claim 9, wherein the first contact includes a lower elastic contact portion which extends to the mating side and a lower side of the second mating part from the base.

11. The electrical connector assembly according to claim 10, wherein the first contact includes a side elastic contact portion which extends to the mating side and sides of the second mating part from the base.

12. The electrical connector assembly according to claim 11, wherein the second contact includes an upper contact portion, which extends to the mating side along a top surface of the second mating part and makes contact with the upper elastic contact portion of the first contact, a lower contact portion, which extends to the mating side along a bottom surface of the second mating part and makes contact with the lower elastic contact portion of the first contact, and a side contact portion, which extends to the mating side along a side surface of the second mating part and makes contact with the side elastic contact portion of the first contact.

13. An electrical connector assembly, comprising a first connector having a first housing, a first contact, and a latch;

a second connector that connects with the first connector and includes a second housing having a second contact and a shell attached to the second housing so as to cover the second housing;

wherein the second contact includes an upper contact portion, which extends to a mating side along a top surface of a second mating part of the second housing and makes contact with an upper elastic contact portion of the first contact, a lower contact portion, which extends to the mating side along a bottom surface of the second mating part and makes contact with a lower elastic contact portion of the first contact, and a side contact portion, which extends to the mating side along a side surface of the second mating part and makes contact with a side elastic contact portion of the first contact.

* * * * *